US005586612A

United States Patent [19]

Isbell et al.

[11] Patent Number: 5,586,612

[45] Date of Patent: Dec. 24, 1996

[54] ROLLER CONE BIT WITH POSITIVE AND NEGATIVE OFFSET AND SMOOTH RUNNING CONFIGURATION

[75] Inventors: Matthew R. Isbell; Rudolf C. O. Pessier, both of Houston, Tex.

[73] Assignee: Baker Hughes Incorporated, Houston, Tex.

[21] Appl. No.: 378,345

[22] Filed: Jan. 26, 1995

[51] Int. Cl.[6] ..... E21B 10/08

[52] U.S. Cl. ..... 175/353; 175/356; 175/376

[58] Field of Search ..... 175/353, 376, 175/350, 356, 398

[56] References Cited

U.S. PATENT DOCUMENTS

| | | | |
|---|---|---|---|
| 1,635,592 | 7/1927 | Wadsworth | 175/353 X |
| 2,147,926 | 2/1939 | Scott | 175/353 |
| 2,148,372 | 2/1939 | Garfield | 175/353 X |
| 4,611,673 | 9/1986 | Childers et al. | 175/353 X |
| 4,657,093 | 4/1987 | Schumacher | 175/353 |
| 4,953,641 | 4/1990 | Pessier | 175/353 |

FOREIGN PATENT DOCUMENTS

| | | |
|---|---|---|
| 1123637 | 2/1962 | Germany . |

*Primary Examiner*—Stephen J. Novosad
*Attorney, Agent, or Firm*—Robert A. Felsman; Mark D. Perdue

[57] ABSTRACT

An earth-boring bit has a bit body and at least a pair of cantilevered bearing shafts depending downwardly and inwardly therefrom. A first cutter is mounted for rotation on one of the bearing shafts and has a region of contact with the sidewall of the borehole. A second cutter is mounted for rotation on another of the bearing shafts and has a region of contact with the sidewall of the borehole that is non-opposite that of the first cutter. Stabilization is provided by a stabilizer pad carried on the bit body and arranged to be opposite the contact regions of the first and second cutters.

9 Claims, 2 Drawing Sheets

ROLLER CONE BIT WITH POSITIVE AND NEGATIVE OFFSET AND SMOOTH RUNNING CONFIGURATION

BACKGROUND OF THE INVENTION

1. Field of the Invention

This invention relates in general to earth-boring bits and in particular to earth boring bits of the type having rotatable cutters with earth disintegrating teeth.

2. Background Information

Earth-boring bits fall generally into two categories: (1) drag bits with a variety of forms including those with synthetic or natural diamond used for cutting elements; (2) those with rotatable cutters having earth disintegrating teeth formed of steel and other suitable metals, such as sintered tungsten carbide.

The rotatable cone type bits have generally two or three cones. The three-cone bit has enjoyed the greater commercial success for a number of reasons, including the fact that they "run smooth". Two-cone bits tend to run rougher, a condition that generates vibration in the bit and drill string that impedes drilling and tends to be detrimental to the drilling rig and equipment. This is because two-cone bits generally contact the sidewall or gage of the borehole at two points, one for each of the cutters. If the two cutters are symmetrical, i.e. 180° apart, with similar offset relative to the axis of rotation of the bit, undesirable dynamics such as backward whirl and off-center rotation can occur. The problem is also present in three-cone bits, but is reduced in magnitude due to the three contact points between the three cutters and the sidewall of the borehole.

Commonly assigned U.S. Pat. No. Re. 34,526, Feb. 1, 1994, to Pessier discloses a two-cone bit in which one of the cutters is skewed such that the cutters are non-opposite and the symmetry referenced above and associated rough running are avoided.

It is advantageous to utilize two-cone bits, if they can be made to run smooth, in some types of earth formations. For example, softer formations can be effectively drilled with two-cone bits, which can have long, more aggressive teeth or cutting elements and permit larger return flow area for the removal of large volumes of cuttings. Additionally, any improvements to the running characteristics of rotatable cutter bits result in longer bit life.

SUMMARY OF THE INVENTION

It is the general object of the invention to provide an earth boring bit of the rolling cutter type with features that minimize off-center rotation and rough running due to bit oscillation brought about by intermittent contact between the bit and the borehole wall.

The foregoing object is achieved by providing an earth-boring bit having a bit body and at least a pair of cantilevered bearing shafts depending downwardly and inwardly therefrom. A first cutter is mounted for rotation on one of the bearing shafts and has a region of contact with the sidewall of the borehole. A second cutter is mounted for rotation on another of the bearing shafts and has a region of contact with the sidewall of the borehole that is non-opposite that of the first cutter. Stabilization is provided by a stabilizer pad carried on the bit body and arranged to be opposite the contact regions of the first and second cutters.

According to the preferred embodiment of the present invention, the first cutter has a positive offset relative to the direction and axis of rotation of the bit and the second cutter has a negative offset relative to the direction and axis of rotation of the bit.

According to the preferred embodiment of the present invention, the stabilizer pad further comprises two stabilizer pads, a first pad opposite the contact region of the first cutter and a second pad opposite the contact region of the second cutter. The stabilizer pads are devoid of cutting elements to provide low-friction stabilization.

Other objects, features, and advantages of the present invention will become apparent with reference to the figures and detailed description, which follow.

DESCRIPTION OF THE PREFERRED EMBODIMENT

Figure 1:
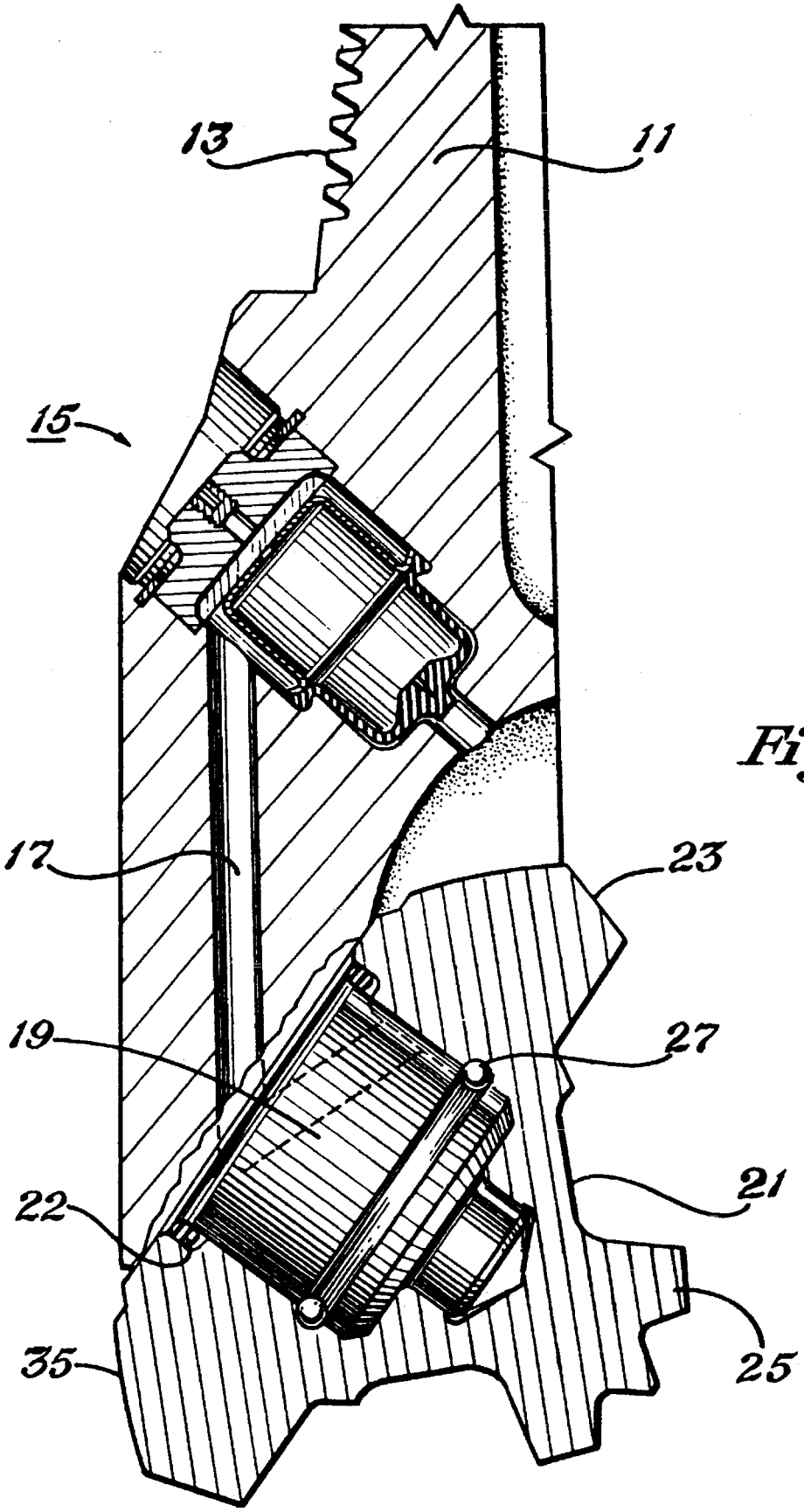
FIG. 1 is a fragmentary longitudinal sectional view of a portion of one section of a two-cone earth boring bit which embodies the principles of the invention.

The numeral 11 in the drawings represents a portion of a section of the body of a two-cone bit having a shank threaded at 13 for connection to the drill string (not shown). This section includes a lubrication and pressure compensator means 15, the description of which may be seen with reference to U.S. Pat. No. 4,727,942, "Compensator for Earth Boring Bits", Mar. 1 1988.

Lubricant is introduced through passages 17 to the surfaces of a bearing shaft 19, which is cantilevered from the section 13 to extend inwardly and downwardly.

A rotatable cutter 21, with rows of earth-disintegrating teeth 23, 25 is secured to the bearing shaft 19 by a plurality of balls 27, which are loaded through a passage (not shown) that is plugged to retain balls 27 in their race.

Lubricant is retained within the bearing surfaces of each cutter and bearing shaft by an O-ring seal 22 as described in U.S. Pat. No. 3,397,928, "Seal Means for Drill Bit Bearings".

Figure 2:
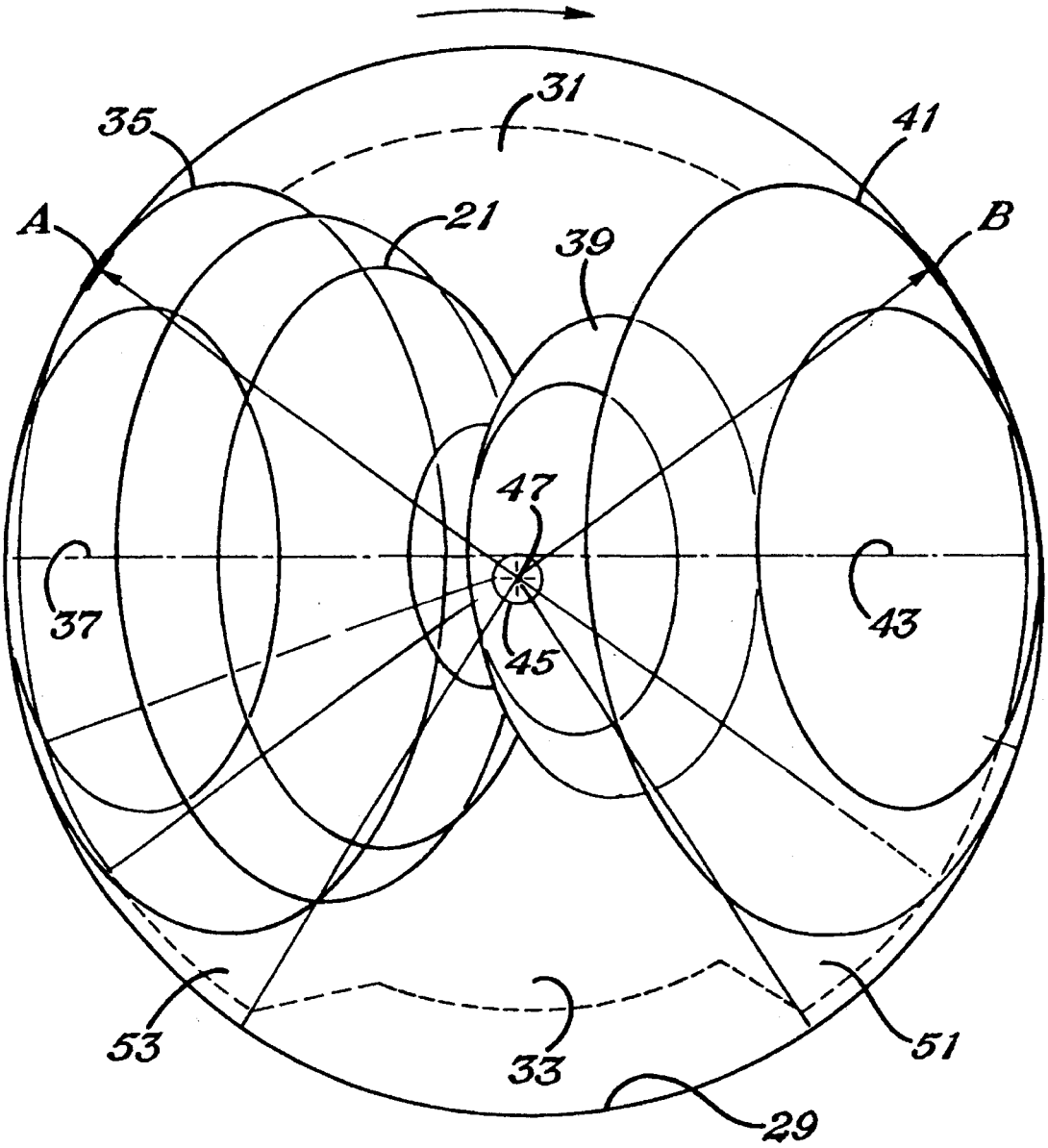
FIG. 2 is a schematic view of the two-cone bit of FIG. 1 as seen from above to show the relationship of the cones.

FIG. 2 illustrates schematically a borehole with a sidewall 29 of selected gage diameter. Two sections 11 (see FIG. 1) are welded to form a bit body, portions of which are represented by the numerals 31, 33, through which drilling fluid flows through passages and nozzles (not shown) to flush cuttings from the borehole to the surface of the earth. A pair of generally conical cutters 21, 39 are disposed generally opposite one another or 180° apart.

Cutter 21 has conical gage surface 35 that engages the borehole wall 29 at a contact point or region A as it rotates about its axis 37. Cutter 39 has a conical gage surface 41 that engages the borehole wall 29 at a contact point or region B as it rotates about its axis 43.

Both the cutters 21, 39 are "offset" to be tangent with a circle 45 surrounding the geometric centerline 47 of the bit, which defines the rotational axis of the bit. Cutter 21 is provided with "positive" offset, meaning that it is offset with respect to the direction and axis of rotation 47 of the bit. With positive offset, the region of contact A of cutter 21 with sidewall 29 is ahead of the axis of rotation 37 of cutter 21. Cutter 39, on the other hand, is provided with "negative" offset with respect to the direction and axis of rotation 47 of the bit. With negative offset, the region of contact B is behind the axis of rotation 43 of cutter 39. According to the preferred embodiment of the present invention, axes of rotation 37, 43 of cutters 29, 39 lie in the same vertical plane. Either positive or negative offset causes cutters 21, 39 to deviate from pure rolling motion and causes them to slide over and scrape the bottom of the borehole.

Stabilizer pads 51, 53 are provided on bit body 11 at locations 180° opposite the regions of contact A, B of cutters 21, 39. Stabilizer pads 51, 53 preferably should extend close to the full gage diameter of the borehole to avoid to counteract rotation of the bit about contact regions A, B instead of about the desirable axis of rotation 47.

Regions of contact A, B of cutters 21, 39 define the perimeter or gage of the borehole as the bit rotates about its center or axis of rotation 47. Because of the contact between cutters 21, 39 and sidewall 29 of the borehole, lateral forces are generated that tend to push the bit off its axis of rotation 47. If cutters 21, 29 have the same or similar offset and are 180° apart, lateral forces generated at region A are counteracted at region B, leading the bit to "bounce" from region to region causing erratic, rough running conditions. Regions A, B are prone to become alternate centers about which the bit may rotate momentarily instead of the geometric center or axis of rotation 47 of the bit. Provision of cutters 21, 39 with differing offsets, as described above, avoids the condition of directly opposed contact regions and any lateral forces generated are resisted by stabilizer pads 51, 53.

Stabilizer pads 51, 53 opposite contact regions A, B help maintain the bit in a smooth operating condition by counteracting the lateral forces and by maintaining engagement of contact regions A, B with sidewall 29 of the borehole, thus reducing the frequency and severity of momentary rotation about regions A, B instead of its central axis 47 of the bit. To avoid their functioning as two more alternate centers, stabilizer pads 51, 53 are preferably devoid of cutting elements and present a smooth, low-friction surface to sidewall 29 of the borehole.

The gage diameter of the borehole is the sum of the distances between axis 47 and point B plus axis 47 and point A. For a bit having a 7⅝ inch gage diameter, the preferred offset of cutters 21, 39 is 3/16 inch (the radius of circle 45) and stabilizer pads 51, 53 are either flush with or have a small clearance from sidewall 29 of the borehole equal to the offset of cutters 21, 39.

It should be apparent from the foregoing description that an invention having significant advantages has been produced. A more smoothly running, continuously engaged bit drills faster and more efficiently and is less prone to premature damages or failure. Another advantage of the bit is the reduction of the tendency to damage the borehole. Therefore, the borehole will not be oversized, and the bit will tend to run smoother.

While the invention has been shown in only one of its forms, it should be apparent to those skilled in the art that it is not thus limited, but is susceptible to various changes and modifications without departing from the spirit thereof.

We claim:

1. An earth-boring bit comprising:

a bit body;

at least a pair of cantilevered bearing shafts depending downwardly and inwardly from the bit body;

a first cutter mounted for rotation on one of the bearing shafts, the first cutter having a region of contact with the sidewall of the borehole;

a second cutter mounted for rotation on another of the bearing shafts, the second cutter having a region of contact with the sidewall of the borehole that is non-opposite that of the first cutter;

a stabilizer pad carried on the bit body, the stabilizer pad being arranged opposite the contact regions of the first and second cutters.

2. The earth-boring bit according to claim 1 wherein the first cutter has a positive offset relative to the axis and direction of rotation of the bit and the second cutter has a negative offset relative to the axis and direction of rotation of the bit.

3. The earth-boring bit according to claim 1 wherein the stabilizer pad is devoid of cutting elements.

4. The earth-boring bit according to claim 1 wherein the stabilizer pad further comprises two stabilizer pads, a first pad opposite the contact region of the first cutter, a second pad opposite the contact region of the second cutter.

5. An earth-boring bit comprising:

a bit body having an axis of rotation;

at least a pair of cantilevered bearing shafts depending downwardly and inwardly from the bit body;

a first cutter mounted for rotation on one of the bearing shafts, the first cutter having a positive offset relative to the axis and direction of rotation of the bit body and a region of contact with the corner and sidewall of the borehole;

a second cutter mounted for rotation on another of the bearing shafts, the second cutter having a negative offset relative to the axis and direction of rotation of the bit body and a region of contact with the corner and sidewall of the borehole;

a stabilizer pad carried on the bit body, the stabilizer pad being arranged opposite the contact regions of the first and second cutters.

6. The earth-boring bit according to claim 5 wherein the stabilizer pads are devoid of cutting elements.

7. The earth-boring bit according to claim 5 wherein the stabilizer pad further comprises two stabilizer pads, a first pad opposite the contact region of the first cutter, a second pad opposite the contact region of the second cutter.

8. An earth-boring bit comprising:

a bit body having an axis of rotation;

a pair of cantilevered bearing shafts depending downwardly and inwardly from the bit body;

a first cutter mounted for rotation on one of the bearing shafts, the first cutter having a positive offset relative to the axis and direction of rotation of the bit body and a region of contact with the corner and sidewall of the borehole;

a second cutter mounted for rotation on another of the bearing shafts, the second cutter having a negative offset relative to the axis and direction of rotation of the bit body and a region of contact with the corner and sidewall of the borehole non-opposite that of the first cutter;

a pair of stabilizer pads carried on the bit body, one stabilizer pad being arranged opposite the contact regions of the first cutter, another stabilizer pad being arranged opposite the contact region of the second cutter.

9. The earth-boring bit according to claim 8 wherein the stabilizer pads are devoid of cutting elements.

* * * * *